US006079421A

United States Patent [19]

Tafoya

[11] Patent Number: 6,079,421

[45] Date of Patent: Jun. 27, 2000

[54] TAPER COMB SET

[76] Inventor: Cherice A. Tafoya, 1153 Market St., Meeker, Colo. 81641-3435

[21] Appl. No.: 09/305,326

[22] Filed: May 5, 1999

Related U.S. Application Data

[60] Provisional application No. 60/084,328, May 5, 1998.

[51] Int. Cl.[7] ..... A45D 24/34

[52] U.S. Cl. ..... 132/213.1; 132/213

[58] Field of Search ..... 132/213.1, 213, 132/214, 148, 144, 219, 212

[56] References Cited

U.S. PATENT DOCUMENTS

| | | | |
|---|---|---|---|
| D. 159,659 | 8/1950 | Mears . | |
| D. 212,660 | 11/1968 | Kress . | |
| 235,571 | 12/1880 | Prevear | 132/219 |
| 1,457,726 | 6/1923 | Cornellier | 132/213.1 |
| 1,676,099 | 7/1928 | Lind | 132/219 |
| 2,163,084 | 6/1939 | Clemens . | |
| 2,380,730 | 7/1945 | Demyanovich . | |
| 2,681,067 | 6/1954 | Zarcone . | |
| 2,698,018 | 12/1954 | Post | 132/213.1 |
| 2,915,071 | 12/1959 | Watkins . | |
| 3,319,507 | 5/1967 | Wolcott | 132/219 |
| 3,575,183 | 4/1971 | Tanner, Sr. . | |
| 3,628,545 | 12/1971 | Moody . | |
| 4,368,745 | 1/1983 | McGuffey | 132/214 |
| 5,213,116 | 5/1993 | Stein | 132/213.1 |

FOREIGN PATENT DOCUMENTS

| | | |
|---|---|---|
| 1205805 | 9/1960 | France . |
| 351549 | 3/1922 | Germany . |
| 2626904 | 12/1977 | Germany . |
| 6-339408 | 12/1994 | Japan . |

*Primary Examiner*—John J. Wilson
*Assistant Examiner*—Pedro Philocene
*Attorney, Agent, or Firm*—Richard C. Litman

[57] ABSTRACT

A set of six taper combs for use in tapered hair cuts, including a full size comb, a medium comb, a small comb, a finger comb capable of manipulation by the fingers on one hand, and two ear combs adapted to shaping a tapered cut above and around the ear.

3 Claims, 3 Drawing Sheets

TAPER COMB SET

CROSS-REFERENCE TO RELATED APPLICATION

This application claims the benefit of U.S. Provisional Patent Application Ser. No. 60/084,328, filed May 5, 1998.

BACKGROUND OF THE INVENTION

The present invention relates to cosmetology and barbering, more specifically being concerned with a set of combs for use by barbers in providing a tapered hair cut.

DESCRIPTION OF RELATED ART

A number of combs have been developed which barbers can use in making a tapered hair cut. The taper comb in U.S. Des. Patent No. 212,660, issued to Kress, is a long comb with a straight edge, the teeth ending in a straight line, with one section of coarse teeth widely spaced, and a second section of fine and densely packed teeth. Other variations of the taper comb have included: a long comb with half straight and half arcuate portions (U.S. Des. Patent. No. 159,659 issued to Mears), a taper comb with arcuate ends for coping with depressions in the scalp (U.S. Pat. No. 2,163,084 issued to Clemens), a taper comb with arcuate ends with the teeth extending radially (U.S. Pat. No. 2,681,067 issued to Zarcone), a taper comb having pairs of teeth, each pair consisting of a full length tooth and an adjacent ½ length tooth (U.S. Pat. No. 2,380,730 issued to Demyanovich), and a taper comb with teeth alternately curved to either side to grip the hair to free both hands for cutting the hair (French Patent 1,205,805 issued to Tournie).

Other related combs, having some features useful for, or common to, tapered combs, include a comb with a handle, a straight back frame, serrated teeth, the ends of the teeth describing a curve (U.S. Pat. No. 2,915,071), a pickup comb (U.S. Pat. No. 3,575,183 issued to Tanner), a teasing comb, tapered, with a band for teasing the hair at the base of the teeth (U.S. Pat. No. 3,628,545 issued to Moody), a comb with the back frame and the ends of the teeth forming an elliptical curve, not being tapered (German patent 351,549 issued to Tiedewitz), a small comb with a curved back and the ends of the teeth describing a curve, particularly for use with an electric trimmer for the hair at the nape of the neck and the area of the ears (German patent 2,626,904 issued to Gerboth), and a comb for close crop radial cuts (Japanese patent 6339408 A).

None of the above inventions and patents is seen to describe the ear combs, the finger comb, or a comprehensive combination or set of tapered combs for administering tapered hair cuts as described herein. None of the above inventions and patents, taken either singly or in combination, is seen to describe the instant invention as claimed.

SUMMARY OF THE INVENTION

There is no single comb available to the professional barber to make a tapered hair cut because of the different sizes of human heads, the different shapes, areas, and accessibility of different regions of the same head, and the size of each individual barber's hands. A professional barber must cut hair quickly to handle a volume of hair cuts while trying to preserve the quality of the cut. Tapered combs to provide a tapered hair cut are usually available in only one size, commonly called a barber's comb. The barber will often substitute a styling comb (having teeth of uniform length and thickness), a beard comb, or some other substitute which does not produce a tapered cut. In the area around the ears, the barber will often curl his finger around the ear for shaping, which is often awkward for the barber who is not ambidextrous.

Accordingly, it is a principal object of the invention to to provide a set of tapered combs having different sizes and shapes adapted to different size heads, to different regions of each individual head, and to the different sizes of hands that individual barbers may have.

It is a further object of the invention to increase the speed, efficiency, convenience and quality in the administration of tapered hair cuts through providing an assortment of tapered combs.

Still another object of the invention is to provide combs for providing a tapered cut in the area above and around the ear.

It is an object of the invention to provide improved elements and arrangements thereof in tapered combs for the purposes described which are inexpensive, dependable and fully effective in accomplishing its intended purposes.

Thus a set of six taper combs for use in tapered hair cuts, including a full size comb, a medium comb, a small comb, a finger comb capable of manipulation by the fingers of one hand, and two ear combs adapted to shaping a tapered cut above and around the ear is provided. The specialized set and functional design of each comb serves the above stated objects and other objects of the present invention as will become readily apparent upon further review of the following specification and drawings.

DETAILED DESCRIPTION OF THE PREFERRED EMBODIMENT

Figure 1:
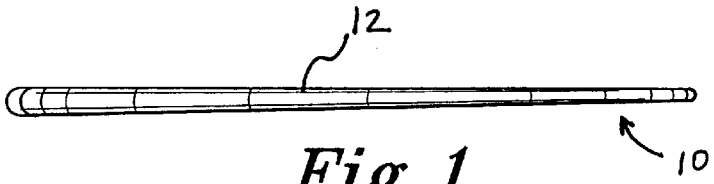
FIG. 1 is a top plan view of an ear comb according to the present invention.

The present invention consists of a set of the six taper combs shown in the drawings.

Figure 2:
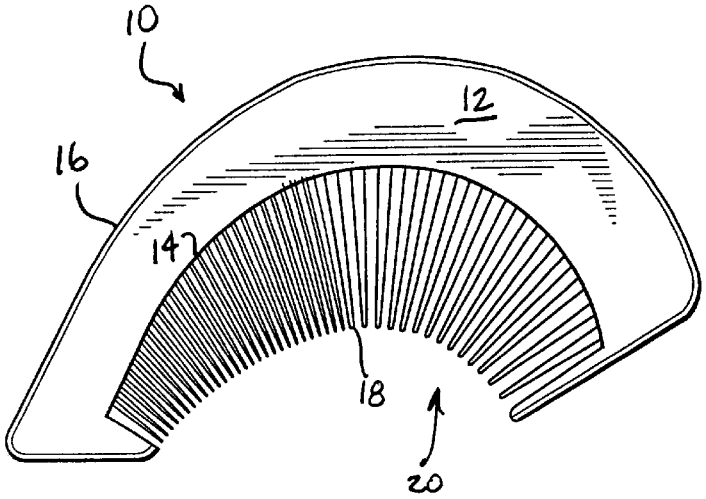
FIG. 2 is a front elevational view of the ear comb as shown in FIG. 1, shown in actual size.

The ear comb 10 shown in FIGS. 1 and 2 is a comb specially adapted for shaping a tapered hair cut in the area above and around the ear. The back frame 12 of the comb is shaped more or less in a parabolic arc with one side 14 shorter than the other side 16. As shown in FIGS. 1 and 2, the width and thickness of the back frame 12 tapers gradually. In the preferred embodiment, an imaginary chord extending defining the minimum and maximum useful lengths from one end of the back frame 12 to the other measures between 3 ¼ to 4 inches. The teeth 20 extend from the concave edge 14 of the back frame 12, progressively tapering in length and thickness. The ends 18 of the teeth, when viewed together, also form a roughly parabolic arc. The size and shape of the ear comb 10 are designed to fit above and around the ear to define a contour around the entire perimeter of the ear. The ear comb 10 is small enough for the barber to hold against either the left ear or the right ear using only one or two fingers and permits a cut of the hair around the ear tapering in length without the necessity of curling a finger around the ear or constantly repositioning a smaller comb around the ear, thereby producing a tapered cut more quickly and conveniently than permitted by the prior art.

Figure 3:
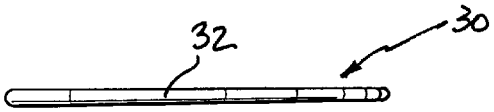
FIG. 3 is a top plan view of a small ear comb according to the present invention.
Figure 4:
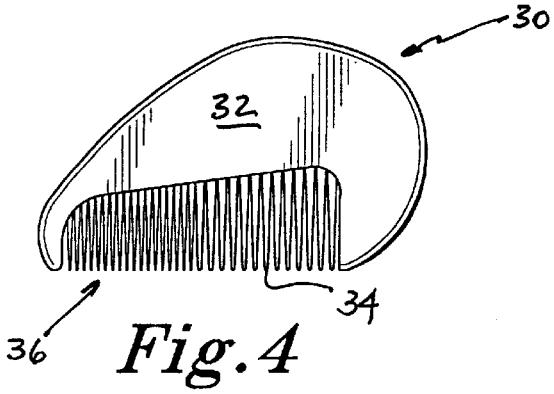
FIG. 4 is a front elevational view of a small ear comb as shown in FIG. 3, shown in actual size.

The comb shown in FIGS. 3 and 4 describes a small ear comb 30. The back frame 32 defines a lobular arc and the ends 34 of the teeth 36 define a straight line across the base of the lobular arc. In the preferred embodiment, the maximum useful lengths of the base range between 1 ¼ and 2 inches. The teeth 36 progressively taper in length and thickness. The small ear comb 30 is useful for shaping hair cuts in the region around the ear of small children. Both ear combs 10, 30 are useful in cutting and trimming in the nape of the neck.

Figure 5:
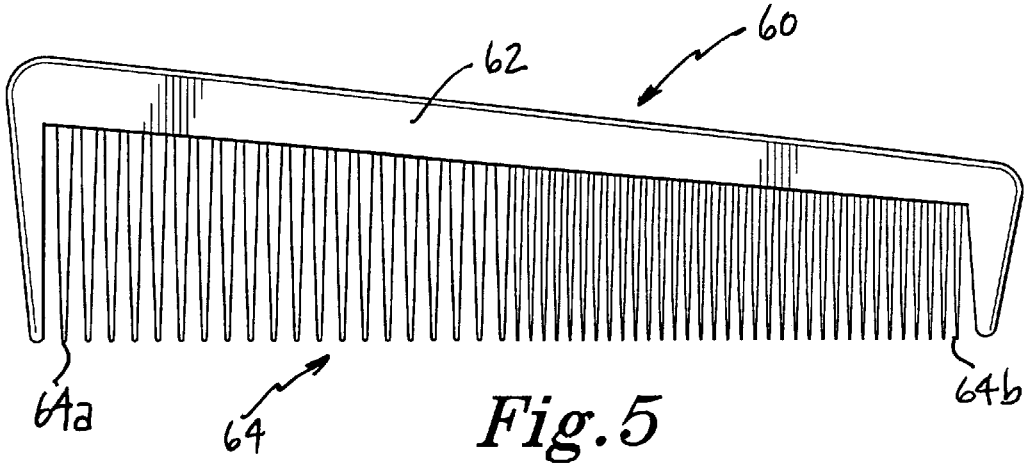
FIG. 5 is a front elevational view of a medium taper comb according to the present invention, shown in actual size.
Figure 8:
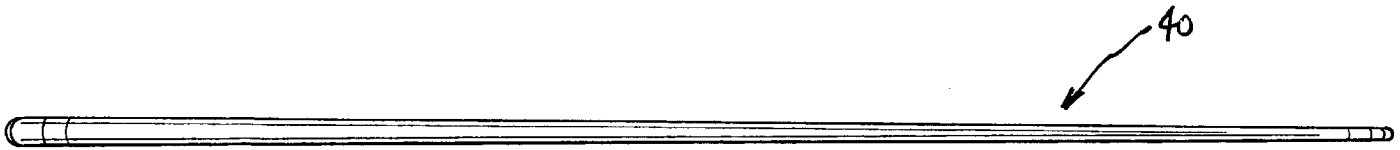
FIG. 8 is a top plan view of a full size taper comb according to the present invention.
Figure 9:
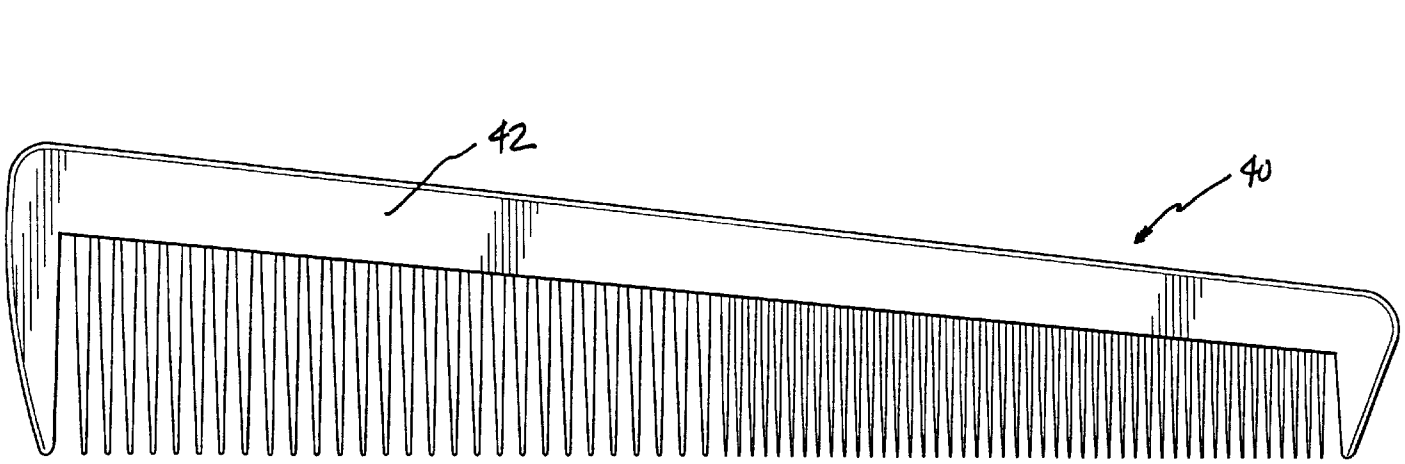
FIG. 9 is a front elevational view, of a full size taper comb as shown in FIG. 8, shown in actual size.
Figure 10:
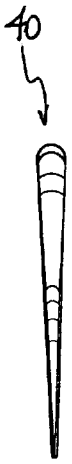
FIG. 10 is an end plan view of a full size taper comb as shown in FIG. 8 and FIG. 9.

The two combs, full size comb 40 shown in FIGS. 8 through 10 and medium comb 60 in FIG. 5, have a similar shape, differing primarily in length. (Since the top plan view and the end plan view of the full size comb 40, medium comb 60, small taper comb 70 and the finger comb 80 all are similar in top plan and end views and can be easily understood by analogy from FIGS. 8 and 10, the top plan view and end view are shown only for the full size taper comb). As shown, the full size taper comb 40 and the medium taper comb 60 have a straight back frame 42,62 and a plurality of teeth 44,64 tapering in length and thickness. In the preferred embodiment, the length of the full size taper comb 40 has a minimum and maximum useful length between 7 ½0 and 8 inches and the medium comb 60 has a similar range of length between 5 ½ and 6 inches. These two combs 40,60 are useful for general cutting and offer the barber a choice for different size heads and convenience in handling.

Figure 6:
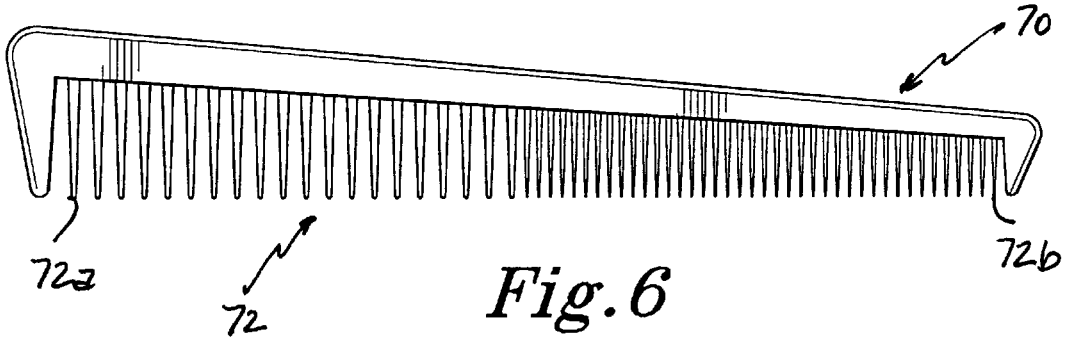
FIG. 6 is a front elevational view of a small taper comb according to the present invention, shown in actual size.

The small taper comb 70 shown in FIG. 6 is similar in shape and length to the medium taper comb 60, but differs in height, the end teeth 72*a*,72*b* having a length approximately ½ the length of the end teeth 64*a*,64*b* of the medium comb 60, the plurality of teeth 72 between the end teeth 72*a*,72*b* progressively tapering in length and thickness. The small taper comb 70 is particularly useful for cutting the hair of small children.

Figure 7:
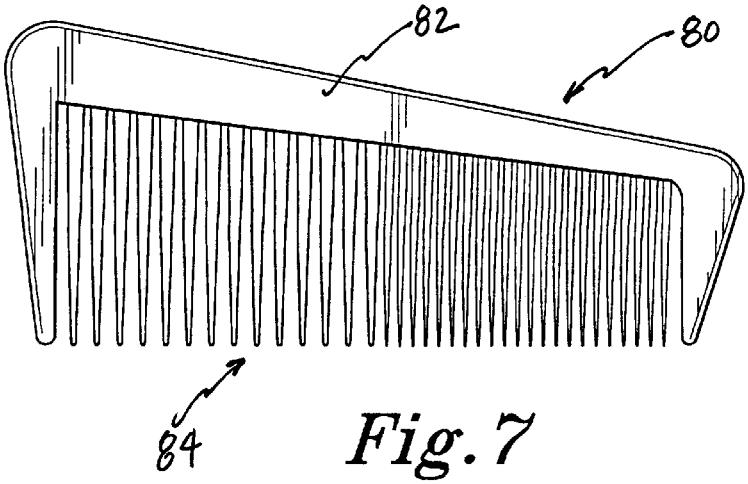
FIG. 7 is a front elevational view of a finger comb according to the present invention, shown in actual size.

The finger comb 80 shown in FIG. 7 is a short comb, the back frame 82 having a length between 3 ¾ and 4 ¼ inches, and a steeper taper, the length and thickness of the teeth 84 tapering at rate approximately 5 to 10% greater than the taper of the full size comb 40, medium comb 60 and small taper comb 70. The shorter length and steeper taper allow the barber to hold the finger comb 80 conveniently between two fingers and is easier to manipulate because of its reduced length.

In the preferred embodiment, all of the combs are made from a hard rubber material. However, the material is not critical, and plastic, hard nylon, or other materials standard in the comb manufacturing trade may be used. The combs may be offered in two sets, one set of a light color and the other of a dark color. The contrast between the color of the comb and the color of the hair being cut speeds the hair cutting process, particularly in the final trim or touch up.

The six combs operate in combination to provide the barber with a complete assortment of taper combs by which he can administer tapered hair cuts to heads of varying sizes and shapes more quickly, conveniently and precisely than the currently available combination of taper combs, style combs, and the barber's own fingers. No single taper comb as known in the related art has proved adequate.

It is to be understood that the present invention is not limited to the sole embodiments described above, but encompasses any and all embodiments within the scope of the following claims.

I claim:

1. An ear comb for cutting and trimming hair superior to the human ear, comprising:

a) a one-piece member having a back frame defining a parabolic arc, the length of the back frame to one side of the vertex of the parabolic arc being shorter than the length of the back frame to the other side of the vertex,
   (i) said back frame of said one-piece member progressively tapering in width and thickness from one end of the back frame to the other,
   (ii) the length of a chord extending from one end of said back frame to the other end of said back frame being between 3 ¼ inches and 4 inches; and b) a plurality of teeth extending from the concave edge of said back frame,
   (i) said teeth being integral with said back frame of said one-piece member,
   (ii) said teeth progressively tapering in length and thickness from one end of the back frame to the other, and
   (iii) the ends of said teeth defining a second parabolic arc in order to define a contour above and around the ear with the comb disposed adjacent to the head and superior to the ear.

2. A small ear comb for cutting and trimming hair superior to the human ear, comprising:

a) a one-piece member having a back frame defining a lobular arc; and b) a plurality of teeth extending from said back frame,
   (i) said teeth being integral with said back frame,
   (ii) the ends of said teeth defining a straight line across the base of the lobular arc defined by said back frame, the length of the base being between 1 ¼ inches and 2 inches, and
   (iii) said teeth progressively tapering in length and thickness.

3. A taper comb set, consisting of:

a) an ear comb for cutting and trimming hair superior to the human ear, comprising:
   (i) a one-piece member having a back frame defining a parabolic arc, the length of the back frame to one side of the vertex of the parabolic arc being shorter than the length of the back frame to the other side of the vertex, said back frame of said one-piece member progressively tapering in width and thickness from one end of the back frame to the other, the length of a chord extending from one end of said back frame to the other end of said back frame being between 3 ¼ inches and 4 inches; and (ii) a plurality of teeth extending from the concave edge of said back frame, said teeth being integral with said back frame of said one-piece member, said teeth progressively tapering in length and thickness from one end of the back frame to the other, and the ends of said teeth defining a second parabolic arc in order to define a contour above and around the ear with the comb disposed adjacent to the head and superior to the ear;

b) a small ear comb for cutting and trimming hair superior to the human ear, comprising:

(i) a one-piece member having a back frame defining a lobular arc; and (ii) a plurality of teeth extending from said back frame, said teeth being integral with said back frame, the ends of said teeth defining a straight line across the base of the lobular arc defined by said back frame, the length of the base being between 1 ¼ inches and 2 inches, and said teeth progressively tapering in length and thickness;

c) a full size taper comb having a one-piece member including:

(i) a straight back frame having a length between 7 ½ and 8 inches, (ii) a integral end tooth at each end of said back frame, and (iii) a plurality of teeth integral with and extending from said back frame parallel to and between said end teeth, said plurality of teeth progressively tapering in length and thickness;

d) a medium taper comb having a one-piece member including:

(i) a straight back frame having a length between 5 ½ and 6 inches;

(ii) a integral end tooth at each end of said back frame, and (iii) a plurality of teeth integral with and extending from said back frame parallel to and between said end teeth, said plurality of teeth progressively tapering in length and thickness;

e) a small taper comb having a one-piece member including:

(i) a straight back frame having a length between 5 and 5 ½ inches, (ii) a integral end tooth at each end of said back frame, said end teeth having a length ½ the length of the end teeth of said medium taper comb, and (iii) a plurality of teeth integral with and extending from said back frame parallel to and between said end teeth, said plurality of teeth progressively tapering in length and thickness;

f) a finger comb having a one-piece member including:

(i) a straight back frame having a length between 3 ¾ inches and 4 ¼ inches, (ii) an integral end tooth at each end of said back frame, and (iii) a plurality of teeth integral with and extending from said back frame parallel to and between said end teeth, said plurality of teeth progressively tapering in length and thickness at a rate between 5 and 10% greater than the taper of said full size taper comb, whereby the finger comb has a greater height relative to its length than the said taper combs.

* * * * *